US006929478B1

(12) United States Patent
Spencer et al.

(10) Patent No.: US 6,929,478 B1
(45) Date of Patent: Aug. 16, 2005

(54) DEVICES, SYSTEMS AND METHODS FOR PERFORMING AND PRACTICING AERIAL MANEUVERS

(76) Inventors: Monte B. Spencer, 15008 58th La. Northeast, Kenmore, WA (US) 98028; Jonathan W. Moore, 15925 81st Pl. Northeast, Kenmore, WA (US) 98028

( * ) Notice: Subject to any disclaimer, the term of this patent is extended or adjusted under 35 U.S.C. 154(b) by 74 days.

(21) Appl. No.: 10/690,221

(22) Filed: Oct. 20, 2003

Related U.S. Application Data

(60) Provisional application No. 60/419,733, filed on Oct. 18, 2002.

(51) Int. Cl.[7] ..... A63B 69/00
(52) U.S. Cl. ..... 434/247; 482/143
(58) Field of Search ..... 434/247, 253; 472/17, 20, 118; 482/71, 143, 144

(56) References Cited

U.S. PATENT DOCUMENTS

| | | | | | |
|---|---|---|---|---|---|
| 474,486 | A | * | 5/1892 | Schmid | 482/96 |
| 1,666,961 | A | * | 4/1928 | Delvin | 135/144 |
| 3,379,439 | A | * | 4/1968 | Sorenson et al. | 482/25 |
| 4,014,540 | A | * | 3/1977 | Caulkins | 472/14 |
| 4,084,812 | A | * | 4/1978 | Melrose et al. | 472/118 |
| 4,289,310 | A | * | 9/1981 | Weakly | 472/118 |
| 4,396,189 | A | * | 8/1983 | Jenkins | 482/71 |
| 4,909,503 | A | * | 3/1990 | Olson | 482/71 |
| 4,961,574 | A | * | 10/1990 | Lew | 472/17 |
| 4,976,623 | A | * | 12/1990 | Owsley | 434/247 |
| 5,152,691 | A | * | 10/1992 | Moscarello | 434/247 |
| 5,403,253 | A | * | 4/1995 | Gaylord | 482/43 |
| 5,509,871 | A | * | 4/1996 | Giovanni | 482/51 |
| 5,662,555 | A | * | 9/1997 | Cloutier | 482/23 |
| 6,093,024 | A | * | 7/2000 | Sokolowski | 434/247 |
| 6,095,819 | A | * | 8/2000 | Ferrand et al. | 434/247 |
| 6,178,978 | B1 | * | 1/2001 | Rieber | 135/96 |

* cited by examiner

*Primary Examiner*—Kurt Fernstrom
(74) *Attorney, Agent, or Firm*—Seed IP Law Group PLLC

(57) ABSTRACT

The disclosure and claims are generally related to a modified sports board, such as a modified skateboard operatively attached to a frame structure. The frame structure is configured to react the multi-directional dynamic forces of a user performing aerobatic maneuvers and related stunts. Proximately located near the frame structure can be a platform where the sports board may be initially mounted. The platform may have a plurality of starting levels or tiers accessible by a standard ladder or steps. The platform may be integrally connected to the frame structure or unattached. Coupled to the platform or in close proximity thereof may be stunt devices, such as rails and ramps. The rails and ramps provide a user with obstacles to maneuver around or grind across.

18 Claims, 11 Drawing Sheets

DEVICES, SYSTEMS AND METHODS FOR PERFORMING AND PRACTICING AERIAL MANEUVERS

CROSS-REFERENCE TO RELATED APPLICATION

This application claims the benefit of U.S. Provisional Patent Application No. 60/419,733 filed Oct. 18, 2002; where this provisional application is incorporated herein by reference in its entirety.

BACKGROUND OF THE INVENTION

1. Field of the Invention

The present description generally relates to devices, systems, and methods for performing and practicing aerial maneuvers for activities such as snowboarding, skateboarding, wakeboarding, and kite-boarding.

2. Description of the Related Art

In recent years, action sports such as skateboarding and snowboarding have become increasingly popular. According to the National Sporting Goods Association, the total number of snowboarders in the U.S. has increased from 2,000,000 in 1994 to 4.3 million in 2000, to 5.6 million in 2002. Transworld magazine states the rapid increase will continue and by 2003, there will be over 7 million snowboarders in the U.S. With the extreme increase in popularity, comes an increase in innovation of flips, spins, and gravity defying tricks. The mechanics and design of the equipment for the respective sports allows the user to perform aerial flips and spins. These aerial tricks are dangerous on the snow and at skate parks and many injuries have occurred as a result. With millions of snowboarders and skateboarders attempting aerial stunts, proper training and practice before going out is essential.

Due to the fact snowboarding is primarily a seasonal activity, participation of the sport is limited to those time periods where enough snow is present and the weather is endurable. As a result, snowboarders are unable to perform or practice aerial tricks at least six months out of the year. Because of this, the opportunity for a snowboarder to train or practice aerial tricks is essentially limited.

BRIEF SUMMARY OF THE INVENTION

This disclosure generally relates to a modified sports board, such as a modified skateboard or snowboard operatively attached to a frame structure. The frame structure is configured to safely react the multi-directional dynamic forces of a user performing acrobatic maneuvers and related stunts. Located near the frame structure is a platform where the sports board may be initially mounted. The platform may have a plurality of starting levels or tiers accessible by a standard ladder or steps. The platform may be integrally connected to the frame structure or unattached. Coupled to the platform or in close proximity thereof may be stunt devices, such as rails and ramps. The rails and ramps provide a user with obstacles to maneuver around or grind across.

In one aspect, a training assembly for practicing dynamic maneuvers comprising a plurality of interconnecting support members, the respective interconnecting support members being configured to form a dome-like frame structure; a first member having a plurality of segments, each segment configured to be detachably connected to at least some of the support members at an apex of the training assembly; a modified action sports board configured with a top portion and a lower portion; and a support means for distally connecting the sports board to the first member.

In another aspect, a training assembly for practicing dynamic maneuvers comprising a plurality of interconnecting support members having upper support members, lower support members, and intermediate support members, the respective interconnecting support members being configured to form a dome-like frame structure; a first member having a plurality of segments, each segment configured to be detachably connected to one of the upper support members at an apex of the training assembly; a modified action sports board configured with a top portion and a lower portion; and a support means for distally connecting the sports board to the first member.

DETAILED DESCRIPTION OF THE INVENTION

In the following description, certain specific details are set forth in order to provide a thorough understanding of various embodiments of the invention. However, one skilled in the art will understand that the invention may be practiced without these details. In other instances, some well-known structures and associated mechanical fastening techniques have not been describe in detail to avoid unnecessarily obscuring the descriptions of the embodiments of the invention.

Unless the context requires otherwise, throughout the specification and claims which follow, the word "comprise" and variations thereof, such as "comprises" and "comprising" are to be construed in an open, inclusive sense, that is as "including but not limited to."

Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Further more, the particular features, structures, or characteristics may be combined in any suitable manner in one or more embodiments.

The headings provided herein are for convenience only and do not interpret the scope or meaning of the claimed invention.

Figure 1:
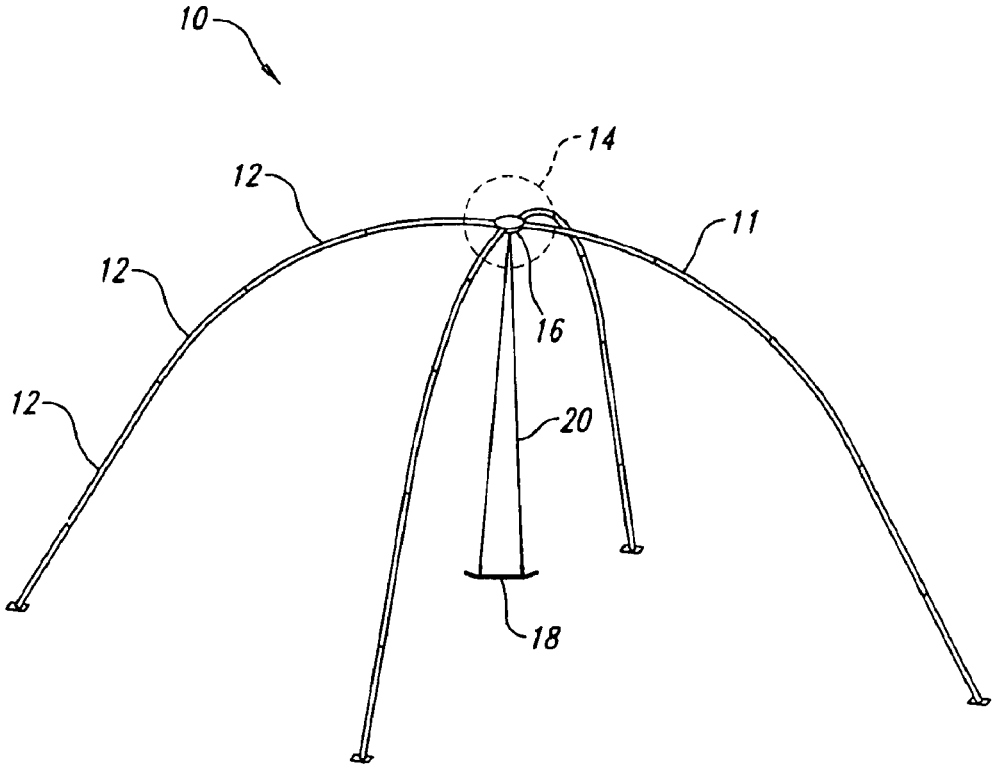
FIG. 1 is a perspective view of a training assembly according to one embodiment of the present invention.

FIG. 1 illustrates a sports board training assembly 10 for the purpose of training, teaching, practicing, and even recreationally entertaining a user to perform maneuvers for sports such as skateboarding, snowboarding, and other similarly related sports. The training assembly 10 may be comprised of a frame structure 11 made up of a plurality of support members 12 where at least some of the support members 12 are connected to a first member 16, located at an apex 14 of the assembly. A sports board 18 can be distally attached with at least one rope 20 to the first member 16 such that a user operating the sports board 18 would be able to attain sufficient momentum to perform a variety of aerial maneuvers related to sports such as snowboarding and skateboarding.

Frame Structure/Support Members

Each of the support members 12 may be configured as a continuous, arched members extending from the first member 16 to the mounting surface, for example, the ground, floor, or other similar surface depending on where the training assembly is assembled. The support members 12 may have a variety of cross sectional shapes, but a tubular cross section is illustrated. A tubular cross section may be the most effective at reacting torsional forces. In addition, the support members 12 may be made from steel, for example stainless steel to reduce corrosion and resist nicking and scratching during assembly or disassembly. The legs of the frame structure 11 can be sufficiently spaced apart and configured with an arch-shape such that the support members 12 would not impede a user during operation of the sports board 18. The distance between each adjacent leg may generally be about twenty-five feet. This distance allows the user to maneuver within the frame structure 11 at high speeds without contacting the frame structure 11.

Still referring to FIG. 1, another embodiment of the training assembly 10 is the frame structure 11 configured with four legs, each leg having a number of interconnected support members 12. The support members 12 may be comprised of upper support members, intermediate support members, and lower support members. Each of the respective support members 12 may be configured with a tapered end and a sleeve end (best depicted in FIG. 8) where the tapered end of one support member is received by the sleeve end of another support member during assembly. The connection of the support members 12 may be by an interference fit, with bolts, with cotter pins, or some other equivalent method of fastening. The connection may be permanent (i.e., not easily disassembled) or may be configured to be quickly disassembled, for example using cotter pins.

In the present embodiment, each support member 12 may generally be about six feet in length. One skilled in the art, having reviewed this disclosure in its entirety, will appreciate that the overall size of the training assembly 10 and thus the length of the support members 12 may be altered depending on any space constraints. For example, an outdoor version of the training assembly 10 may be substantially larger than an indoor version.

Figure 2:
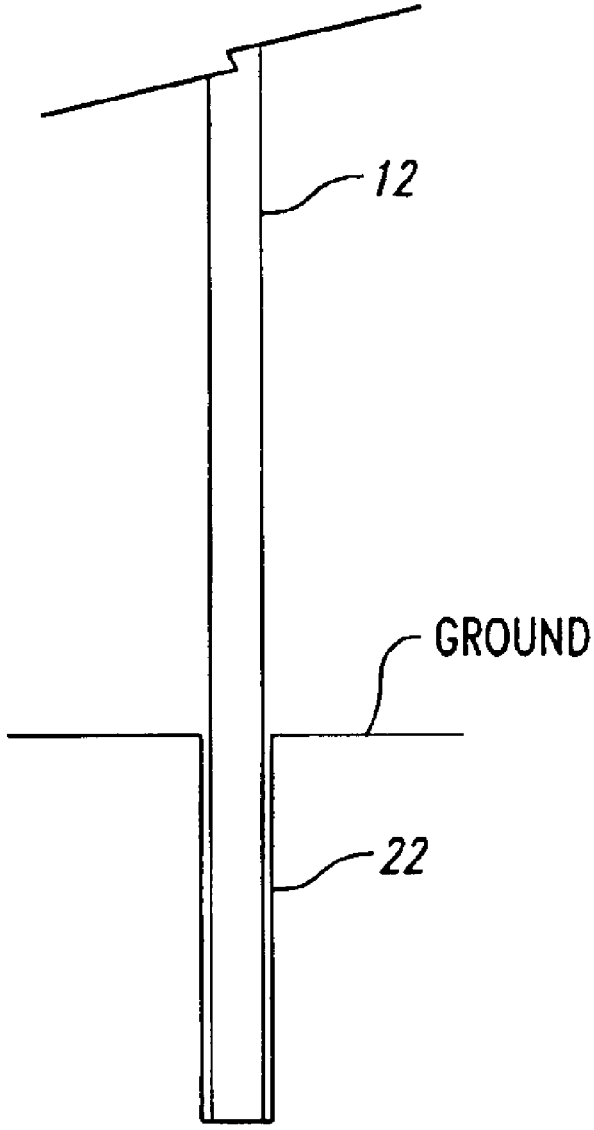
FIG. 2 is side view of a ground sleeve used to anchor the training assembly of FIG. 1.

As illustrated in FIG. 2, the frame structure 11 may be anchored, fixed or stabilized with respect to the available mounting surface, for example, the ground. A ground sleeve 22 can be used to receive one end of at least some of the support members. One skilled in the art, having reviewed this entire disclosure, will appreciate that the depth of insertion below ground level and the closeness of fit between the ground sleeve 22 and the support member 12 can be easily varied to provide for a flexible, but not overly rigid frame structure 11.

In an alternate embodiment, a telescopic foot (not shown) may be attached to at least some of the support members to create a free-standing frame structure such that that each of the respective legs is adjustable in height to compensate for an uneven mounting surface. This allows the free-standing frame structure 11 may be placed at a variety of positions with respect to the contour of the mounting surface. The telescopic foot may include a plurality of holes, each set of holes being alignable with a set of holes in the complementary support member 12. The telescopic foot and the support member 12 may be connected with bolts, cotter pins, or other mechanical means. In addition, the telescopic foot can have a wide base to enhance the stability of the training assembly 10. To further enhance the stability of the assembly 10, stakes, cables, or other anchor-type devices can be used to in conjunction with the wide base of the telescopic foot.

Sports Board

Figure 3:
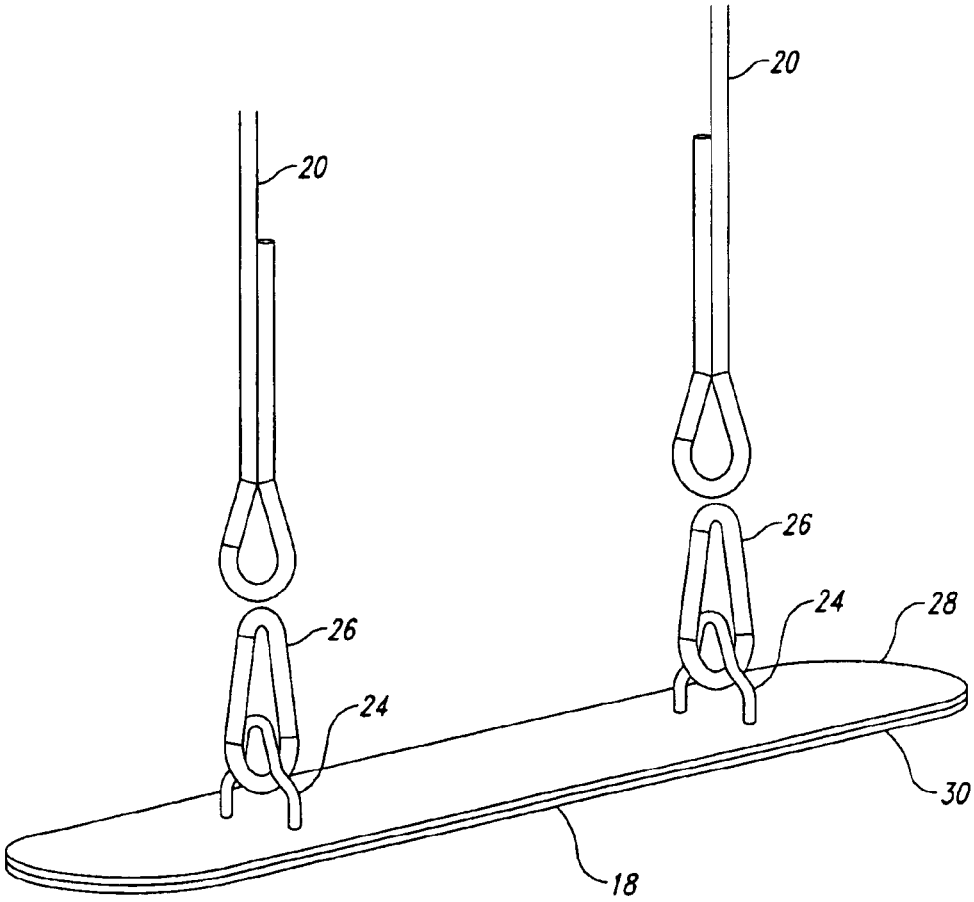
FIG. 3 is perspective view of a sports board of the training assembly of FIG. 1.
Figure 4:
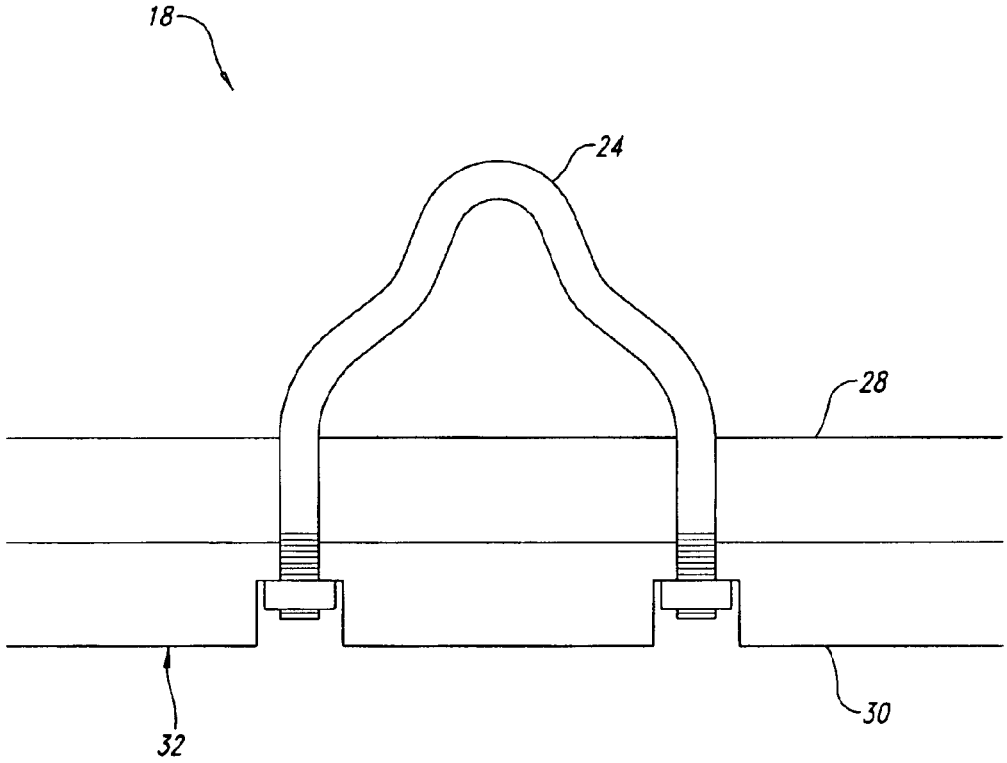
FIG. 4 a cross sectional view of the sports board of FIG. 3.

FIGS. 3 and 4 illustrate one embodiment of the sports board 18. The sports board 18 can have a top portion 28 and a lower board portion 30 where the bottom surface 32 of the lower portion 30 may be configured to be a grind surface for grinding the board across rails or other similar training aids. The top portion 28 can be made of wood similar to a skateboard. The bottom portion or grind plate 30 of the board can be made out of fiberglass or a composite-type material. The grind plate 30 acts as a wear surface and may be replaced over time. The sports board 18 may also include a U-shaped bolt 24 for attaching to a rope 20. The U-bolts 24 are placed near the front and rear locations on the sports board 18 such that the open end of the "U" points downward. The bottom portion 30 of the sports board 18 may include recessed holes for the U-bolt lock nuts. The recessed holes allow the grind plate 30 to have a smooth surface without any protrusions. The rope 20 can be attached directly to the U-bolts 24 or can be attached with a carabineer 26. The attachment of the sports board 18 to the rope 20 with a carabineer 26 permits a rider to easily attach and detach the rope 20 from the U-bolts 24. D-style or standard, oval-shaped carabineers can be used to attach the rope 20 to the sports board 18, to the apex 14 of the frame structure 11, or both. The carabineers can contain a screw-gate or spring-gate locking mechanism.

Figure 5:
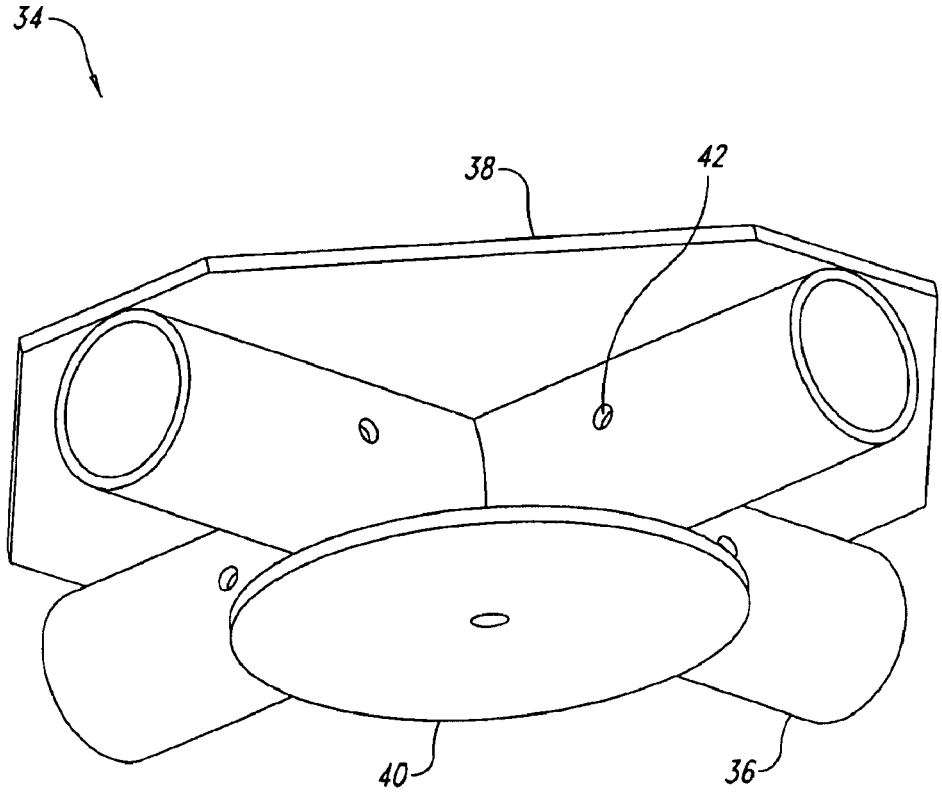
FIG. 5 is a perspective view of a connection member used in the assembly of FIG. 1.
Figure 6:
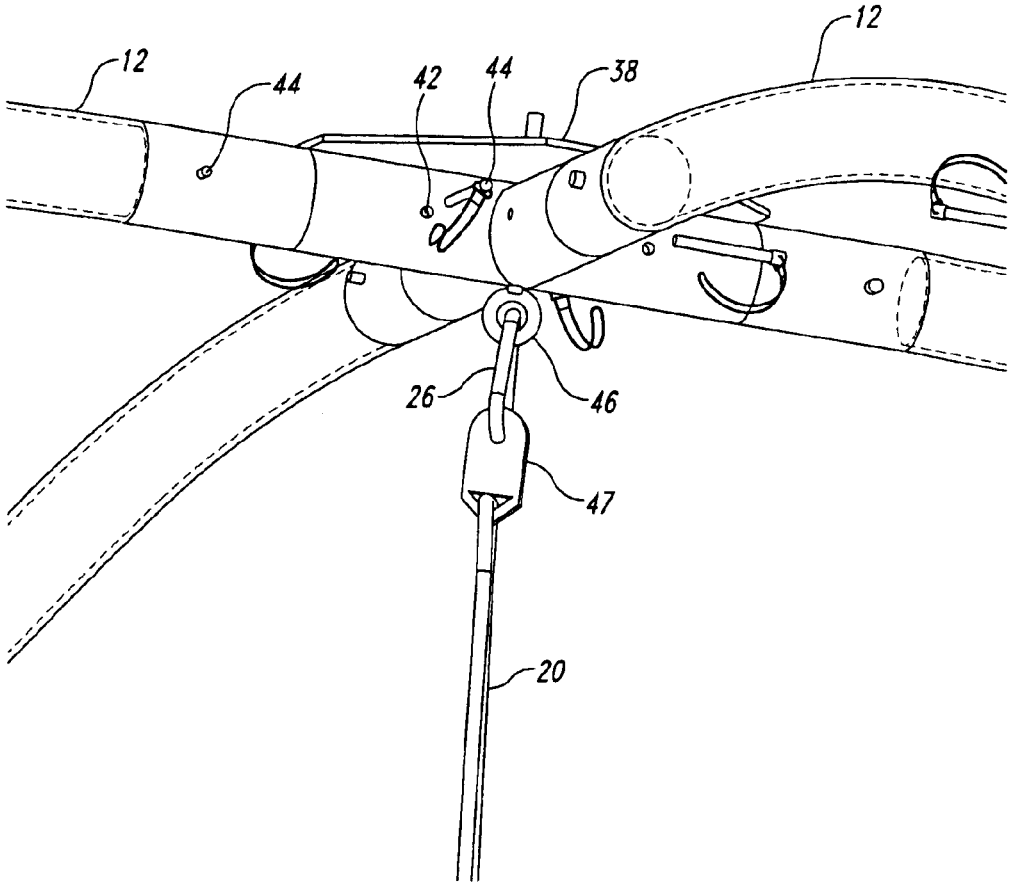
FIG. 6 is a perspective view of a ring device connected to the connection member of FIG. 5.

As illustrated in FIGS. 5 and 6, a reinforced cross member 34 may be used to join the support members 12. The cross member 34 can have at least four sleeves 36 for receiving the support members 12. Similar to the attachment of the support members 12 with one another, the sleeves 36 can have cross holes 42 for accepting a fastening means 44, such as bolts or cotter pins, which provide for quick assembly and disassembly. An upper plate 38 and a lower plate 40 can be used to reinforce the assembly.

Referring to FIG. 6, one embodiment for assembling the sports board 18 to the cross member 34 can be a ring device 46. The ring device 46 can be secured to the cross member 34 at the apex 14 of the assembly. A carabineer 26 can be used to attach the rope 20 to the ring device 46. Alternatively, the rope 20 may be threaded through the ring device 46. One skilled in the art, having reviewed this entire disclosure, will understand that an intermediate connection between the rope 20 and the ring device 46 will reduce any wear on the ring device 46 from the rope 20. The ropes 20 can also be attached to the ring device 46 with a thimble 47, which may be made of steel or aluminum, to prevent the rope 20 from contacting the carabineer.

Figure 7:
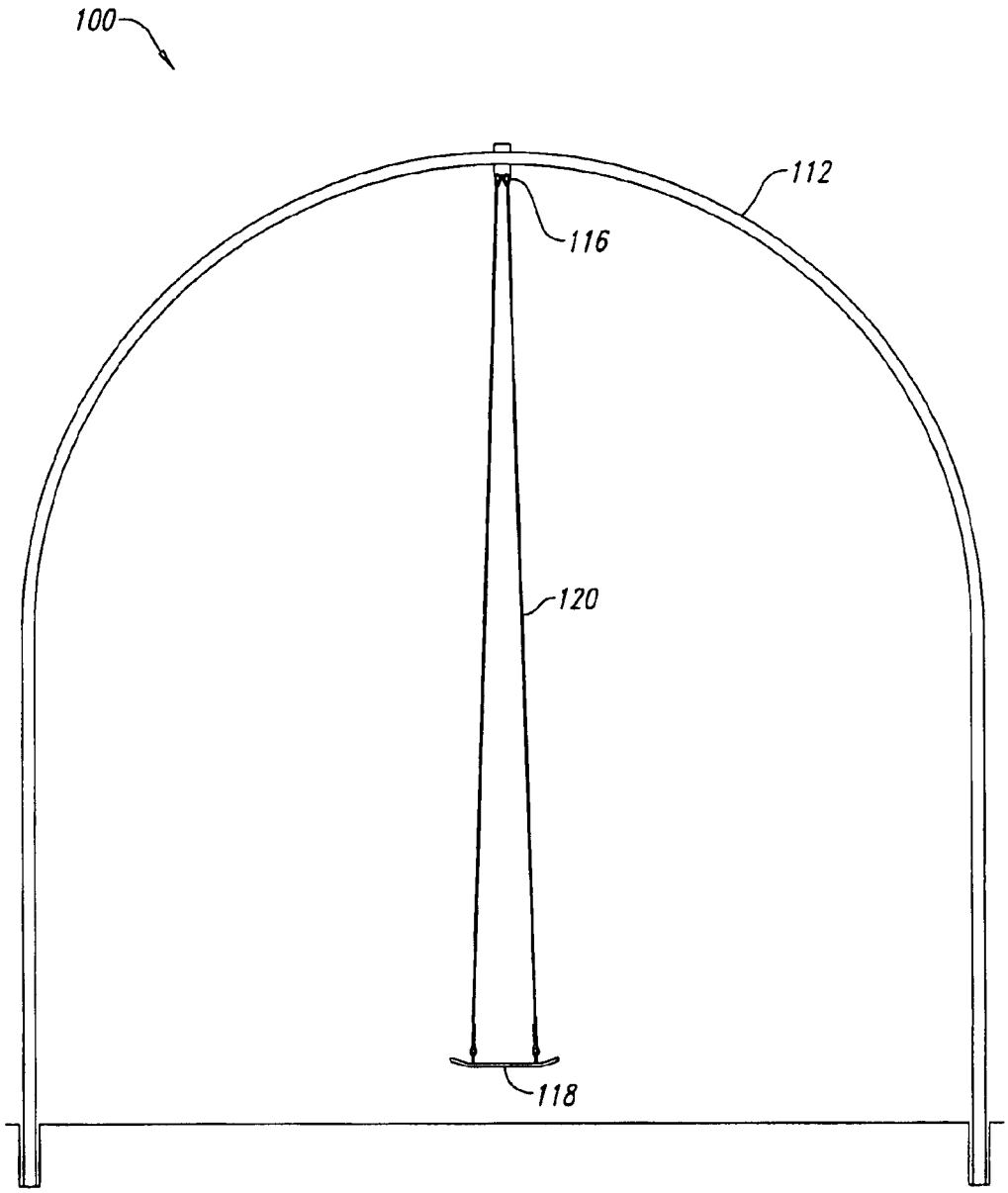
FIG. 7 is a cross sectional view of another embodiment of a training assembly having a double-D connector.
Figure 8:
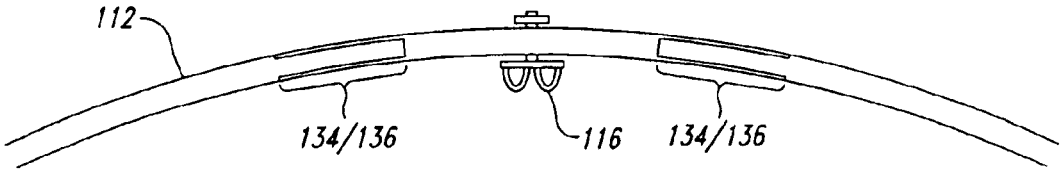
FIG. 8 is a side view of the double-D connector of FIG. 7.
Figure 9:
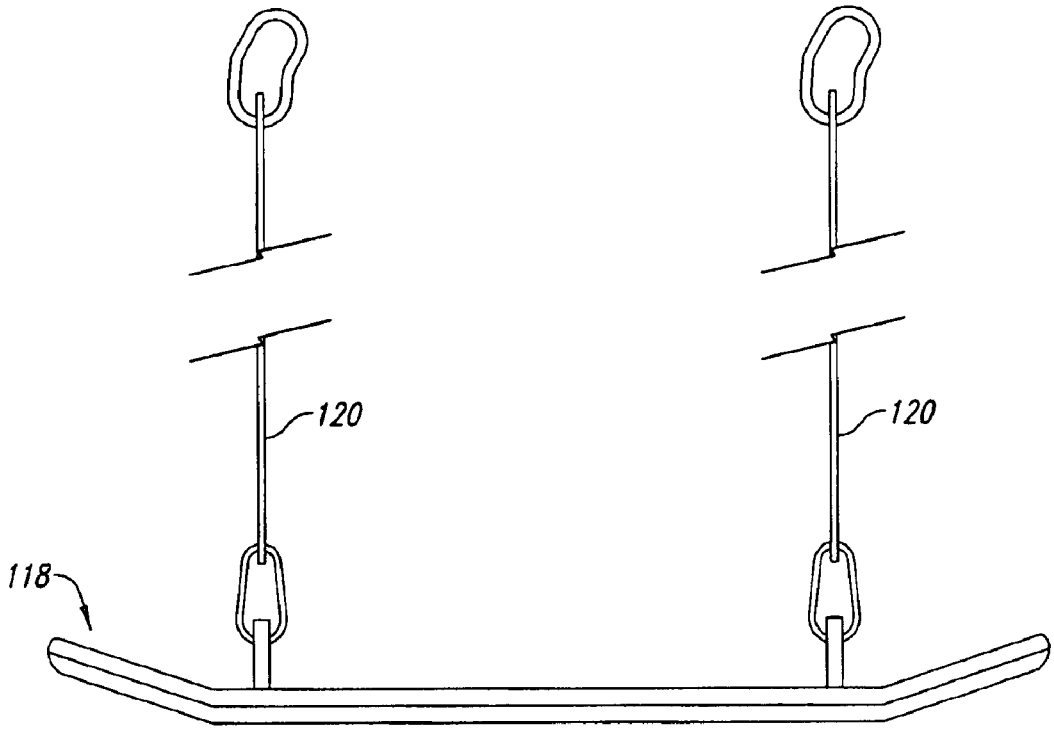
FIG. 9 is a cross sectional view of the sports board configured to be connected to the training assembly of FIG. 7.

FIGS. 7–9 illustrate an alternate embodiment of the present invention, where the connection member 116 can be a double-D ring (e.g., two closed structural loops integrally connected to a support spine). The assembly 100 with the double-D connection 116 permits two independent rope segments 120 to be attached to the sports board 118. The double D-connection 116 acts as the structural interface between the dynamic portion of the sports board 118 and the support members 12. The double D-connection 116 may be coated with Teflon or crafted from a hardened, wear resistant material. The support members 112 can have a tapered end 134 and a sleeve end 136 for quick and efficient assembly or disassembly.

Figure 10:
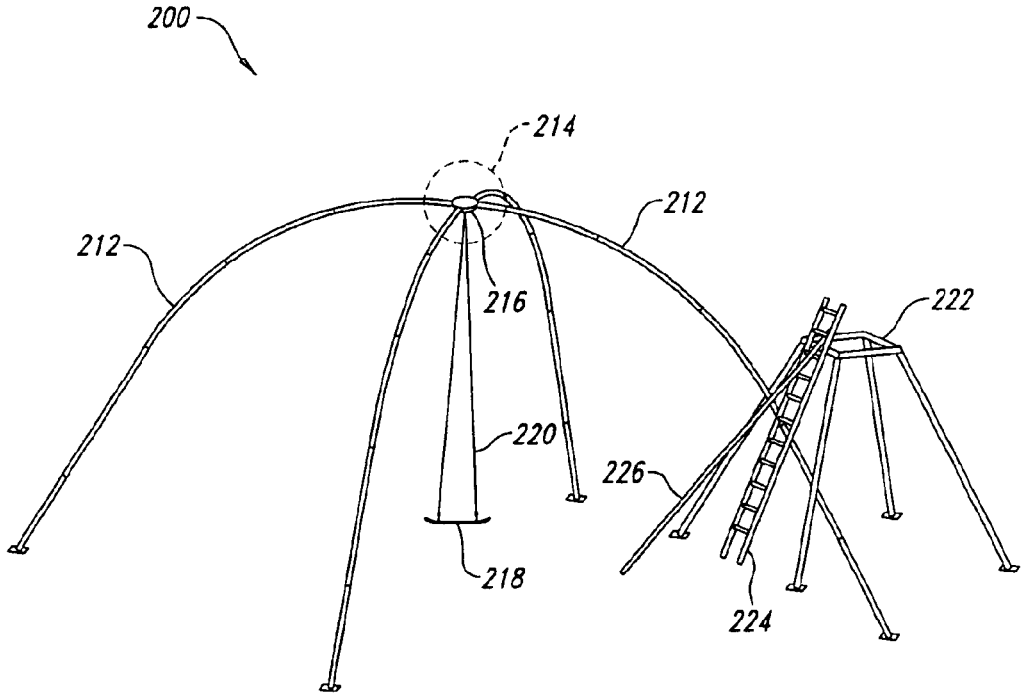
FIG. 10 is a perspective view of another training assembly having a platform and grind rail.
Figure 11:
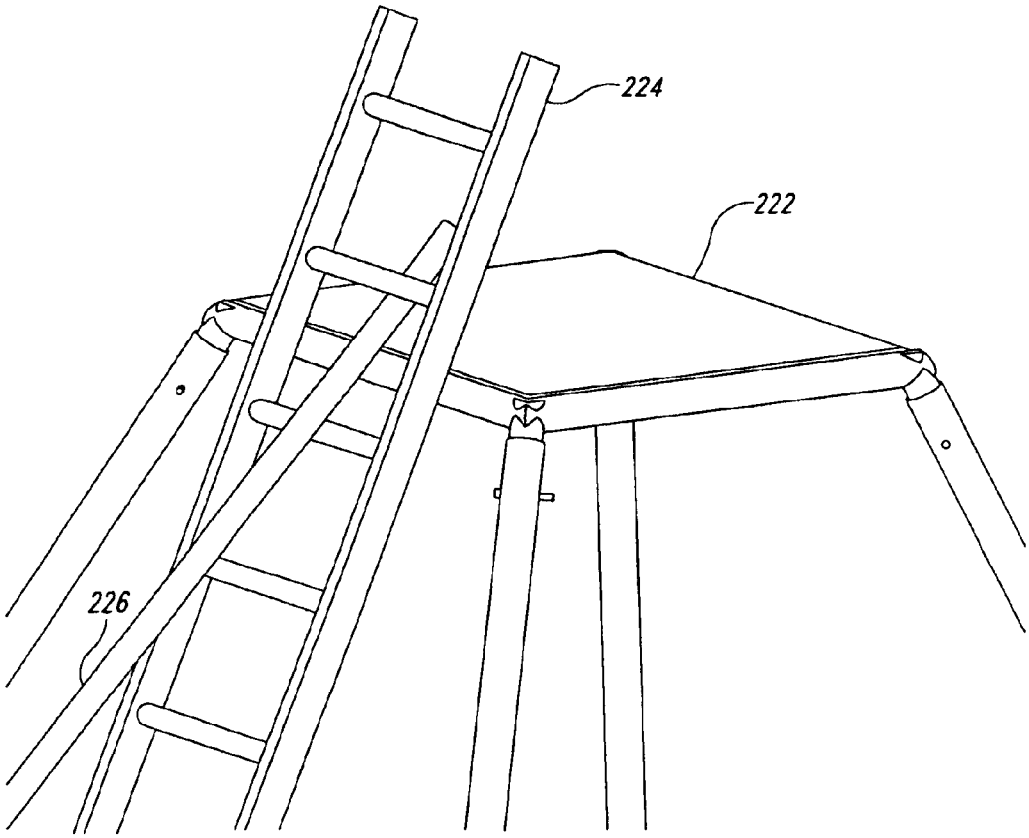
FIG. 11 is a perspective view of the platform and grind rail of FIG. 10.

Illustrated in FIGS. 10 and 11, an alternate embodiment of the assembly 200 is configured with the support members 212 attached at an apex 214 with a connection member 216. A rope 220 provides the attachment to the sports board 218. Additionally, the assembly 200 may include a platform 222 configured with a stepping device 224, such as a ladder or staircase, for allowing a rider access to the platform 222. The platform 222 may also be used to support a grind rail 226. The grind rail 226 can be utilized by the riders to perform a variety of stunts.

There are several advantages of the sports board apparatus. For example, the apparatus can provides an effective means for users to practice technique and stunts, with a potential for a decreased risk of injury as compared to learning by trial and error. Each snowboarder/skateboarder can become comfortable with the tricks on the Sports board training device, thus may run a reduced risk of injury due to the fact the rider is experienced and has training. Second, if multiple strands of rope are used to attach each side of the sports board to the apex of the frame structure, then a failure of a single strand would not necessarily compromise the safety of the rider. Although it is not necessary to use rope, it will most likely provide the most cost efficient means to attach the sports board. Additionally, rope may be easily inspectable for excessive or harmful wear patterns and can be quickly replaced.

An additional feature of the invention is that the rider can wear a safety harness to clip or tie-in to the ropes. It is anticipated that typical rock-climbing style safety harnesses could be utilized such as a Black Diamond Chaos harness or a Petzl Corax harness or others. Further, handles may be affixed to the ropes to provide the user with added stability during maneuvers.

Another advantage of the assembly is that the sports board can be easily detachable. This permits riders to use their own personal sports board when training.

Another advantage of the inventive assembly is that it provides an off-season training tool for users such as snowboarders. Thus, a sports board training device can permit a snowboarder to practice at any time of the year under any weather conditions.

It is therefore an object of the present invention to provide for a novel training, teaching, recreational device whereby the rider can feel confident to perform and practice maneuvers for sports such as skateboarding, snowboarding, and other similarly related sports.

It is to be understood that variations can be made in the specific operating device by one skilled in the art and thus the invention is not to be limited to the specific embodiments illustrated herein.

While various embodiments of the present invention have been described above, it should be understood that they have been presented by the way of example only, and not limitation. It will be understood by those skilled in the art that various changes in form and details may be made therein without departing from the spirit and scope of the invention as defined in the appended claims. Thus, the breadth and scope of the present invention should not be limited by any of the above-described exemplary embodiments, but should be defined in accordance with the following claims and their equivalents.

All of the above U.S. patents, U.S. patent application publications, U.S. patent applications, foreign patent applications and non-patent publications referred to in this specification and/or listed in the Application Data Sheet, are incorporated herein by reference, in their entirety.

What is claimed is:

1. A training assembly for use in practicing dynamic maneuvers, the assembly comprising:

a plurality of interconnected support members, the respective interconnecting support members being configured to form a substantially dome-like frame structure;

a first member having a plurality of segments, each segment configured to be detachably connected to at least some of the support members at an apex of the training assembly;

a modified action sports board configured with a top portion and a lower portion; and a support means for connecting the sports board to the first member.

2. The training assembly of claim 1, further comprising a telescopic foot attached to at least several of the support members.

3. The training assembly of claim 1, further comprising a ground sleeve for receiving at least some of the support members.

4. The training assembly of claim 1 wherein the plurality of support member further comprises:

a set of upper support members for attaching to the first member;

a set of lower support members;

a set of intermediate support members for providing a continuum of detachable connections between the upper support members and the lower support members.

5. The training assembly of claim 1 wherein the support members are configured with a tubular cross section.

6. The training assembly of claim 1 wherein the support members are spaced to sufficiently stabilize the training assembly.

7. The training assembly of claim 1, further comprising a plate affixed to the connection member for resisting downward deflection at the apex of the training assembly.

8. The training assembly of claim 1 wherein the support means includes one continuous rope segment for attaching the sports board to a ring unit, the ring unit being connected to the first member, a central section of the rope segment being supported by the ring unit with each end of the rope segment being attached to each side of the sports board.

9. The training assembly of claim 1 wherein the support means includes at least two rope segments for attaching the sports board to a double D-ring member, the D-ring member is connected to the first member, and for each of the rope segments, one end of each of the rope segments is attached to one of the D-rings with the other end of each of the rope segments being attached to the sports board.

10. The training assembly of claim 1, further comprising a platform proximally located to the training assembly for providing a user with mountable access on the sports board from an elevated position.

11. The training assembly of claim 1, further comprising at least one grind rail located in the vicinity of the training assembly to permit a user to slidably engage the grind rail with the bottom surface of the sports board while performing maneuvers.

12. A training assembly for practicing dynamic maneuvers, the assembly comprising:

a plurality of interconnected support members comprising upper support members, lower support members, and intermediate support members, the respective interconnecting support members being configured to form a dome-like frame structure;

a first member having a plurality of segments, each segment configured to be detachably connected to one of the upper support members at an apex of the training assembly;

a modified action sports board configured with a top portion and a lower portion; and a support means for connecting the sports board to the first member.

13. The training assembly of claim 12, further comprising a plate affixed to the connection member for resisting downward deflection at the apex of the training assembly.

14. The training assembly of claim 12 wherein the interconnecting support members are configured with a tapered end and a sleeve end, the tapered end of one support member being received by the sleeve end of a different support member during assembly.

15. The training assembly of claim 12 wherein the support means includes one continuous rope segment for attaching the sports board to a ring unit, the ring unit being connected to the first member, a central section of the rope segment being supported by the ring unit with each end of the rope segment being attached to each side of the sports board.

16. The training assembly of claim 12 wherein the support means includes at least two rope segments for attaching the sports board to a double D-ring member, the D-ring member is connected to the first member, and for each of the rope segments, one end of each of the rope segments is attached to one of the D-rings with the other end of each of the rope segments being attached to the sports board.

17. The training assembly of claim 12, further comprising a platform proximally located to the training assembly for providing a user with mountable access on the sports board from an elevated position.

18. The training assembly of claim 12, further comprising at least one grind rail located in the vicinity of the training assembly to permit a user to slidably engage the grind rail with the bottom surface sports board while performing maneuvers.

* * * * *

UNITED STATES PATENT AND TRADEMARK OFFICE

CERTIFICATE OF CORRECTION

PATENT NO. : 6,929,478 B1
DATED : August 16, 2005
INVENTOR(S) : Monte B. Spencer et al.

It is certified that error appears in the above-identified patent and that said Letters Patent is hereby corrected as shown below:

Title page,
Item [57], ABSTRACT,
Line 2, "skateboard operatively" should read as -- skateboard or snowboard operatively --.

Column 8,
Line 24, "surface sports" should read as -- surface of the sports --.

Signed and Sealed this

Twenty-second Day of November, 2005

JON W. DUDAS
*Director of the United States Patent and Trademark Office*